United States Patent [19]

Dillinger

[11] 4,194,258

[45] Mar. 25, 1980

[54] MACHINE FOR REAMING TUBES OF DIFFERENT LENGTHS

[76] Inventor: Lester L. Dillinger, 1569 W. 17th St., Long Beach, Calif. 90813

[21] Appl. No.: 21,108

[22] Filed: Mar. 15, 1979

[51] Int. Cl.[2] ..... B08B 9/02

[52] U.S. Cl. ..... 15/104.1 R

[58] Field of Search ..... 15/104.1 R, 104.1 C, 15/104.16, 104.2, 88

[56] References Cited

U.S. PATENT DOCUMENTS

| | | | |
|---|---|---|---|
| 2,803,842 | 8/1957 | Fuller | 15/104.1 R |
| 3,771,187 | 11/1973 | Dillinger | 15/104.1 R |
| 3,778,858 | 12/1973 | Fuller | 15/104.1 R |
| 3,869,747 | 3/1975 | Richter | 15/104.1 R |

*Primary Examiner*—Edward L. Roberts
*Attorney, Agent, or Firm*—Gene W. Arant

[57] ABSTRACT

A machine for reaming heat exchanger tubes of different lengths includes a drive head, or central power unit; a pair of concentric tubes which are removably attached to the drive head and extend rearwardly from it; and a drive shaft having a drive piston on its rearward end which is reciprocably driven within the inner one of the tubes. The length of the tubes and of the drive shaft is selected according to the length of a particular set of heat exchanger tubes that are to be reamed. When a longer or shorter set of tubes are to be reamed, the machine is modified by removing the tubes and the drive shaft from the drive head, and substituting other like members which are correspondingly longer or shorter, as required.

6 Claims, 7 Drawing Figures

MACHINE FOR REAMING TUBES OF DIFFERENT LENGTHS

PRIOR ART

The present invention is an improvement on the reaming machine disclosed and claimed in my U.S. Pat. No. 4,015,304 issued Apr. 5, 1977.

BACKGROUND OF THE INVENTION

A hydraulically driven tube reaming machine such as that shown in my U.S. Pat. No. 4,105,304 includes a cutterhead mounted on a drive shaft that is somewhat longer than the set of tubes that are to be reamed. Thus, the working space that is required for the machine, adjacent to the heat exchanger, is longer than the heat exchanger itself.

A technique has heretofore been developed for using a machine of fixed length for reaming heat exchanger tubes of different lengths. For example, the machine is constructed of such length as to ream tubes that are 30 feet long. When another set of tubes are to be reamed that are, for example, 15 feet in length, an internal modification is made in the machine to shorten the effective length of its drive cylinder. Thus the machine itself is still 30 feet long plus an additional distance that is required to support the drive shaft, but the working stroke of the drive shaft has been diminished by 15 feet. Of course this type of modification cannot be used at all if the available machine is only 15 feet long and the heat exchanger tubes to be reamed are of a greater length than that.

It sometimes happens that a heat exchanger which is, for example, 15 feet in length has sufficient space adjacent to it to install a reaming machine of the necessary size, but the shape is not large enough to install a bigger reaming machine. In actual practice this has necessitated providing, and transporting to the work location such as an oil refinery, several different reaming machines even though there is only a single crew to operate them. A separate reaming machine or a corresponding size has been required for each size of heat exchanger. A particular reaming machine does not have sufficient reach to operate on a heat exchanger that is longer than what it was designed for. And where the heat exchanger is shorter than what the machine is designed for, the working space beside the heat exchanger may not be sufficient to accommodate the machine. Hence the practical requirement that a single crew must be equipped with several different machines, one for each size of heat exchanger.

When oil refineries are being cleaned and repaired the shut down time is a crucial factor. It is desirable to accomplish the necessary maintenance work such as reaming the heat exchanger tubes in an absolute minimum amount of time. Otherwise the productive capacity of the refinery that is lost can amount to a great deal of money. Hence it is essential that crews who operate tube reaming machines for the necessary maintenance and reconditioning of refinery heat exchangers must be provided with equipment that is efficient and reliable and can be operated at maximum speed.

SUMMARY OF THE INVENTION

According to the invention a reaming machine is provided with a single drive head, or central power unit, plus several sets of removable parts, each corresponding to a different drilling depth that is desired.

Thus for drilling 30 foot tubes one set of removable parts are used in conjunction with the central power unit, and for drilling 15 foot tubes a second and different set of removable parts are used.

Included with each set of removable parts is a drive shaft including a cutting head on its forward end and a drive piston on its rearward end. Also included in the removable parts is a pair of concentric tubes or barrels, the inner one of which constitutes the main part of the drive chamber for the drive piston. The tubes or barrels remain open at their forward end for purpose of attachment to the central power unit, but at their rearward end are permanently fastened together and closed off so as to provide a closed passageway for the hydraulic fluid that is used to drive the drive shaft.

Thus the object and purpose of the present invention is to provide a hydraulically driven tube reaming machine which can be easily modified to accommodate different drilling depths, without requiring any field modification procedures that are time consuming, and in such manner that the machine does not occupy more than the necessary minimum amount of working space.

DRAWING SUMMARY

DETAILED DESCRIPTION

(FIGS. 1-5)

Figure 1:
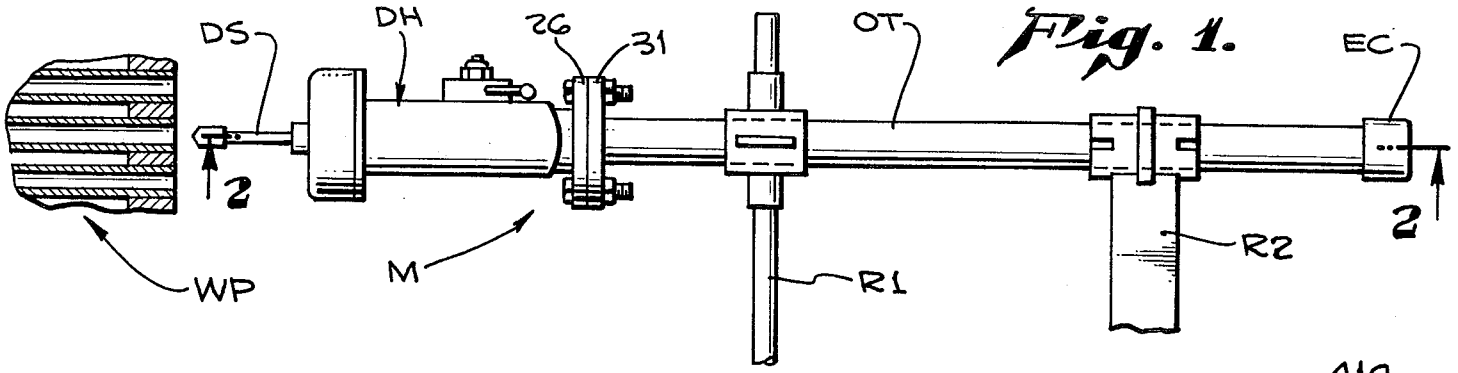
FIG. 1 is a side elevation view of a tube reaming machine in accordance with the present invention.

As shown in FIG. 1 the work piece WP consists of a set of exchanger tubes that are, typically, part of a heat exchanger in an oil refinery. The machine M of the present invention includes a drive head or central power unit DH which is in an essentially forward location. A drive shaft DS extends forwardly from the drive head. An outer tube or barrel OT extends rearwardly from the drive head DH. An end cap EC is attached to the rearward end of the outer barrel OT. The machine also includes a supporting rack structure including rack members R1 and R2 which, however, are in precise accordance with the mechanism shown in my U.S. Pat. No. 4,015,304 and therefore do not require detailed description here.

Figure 2:
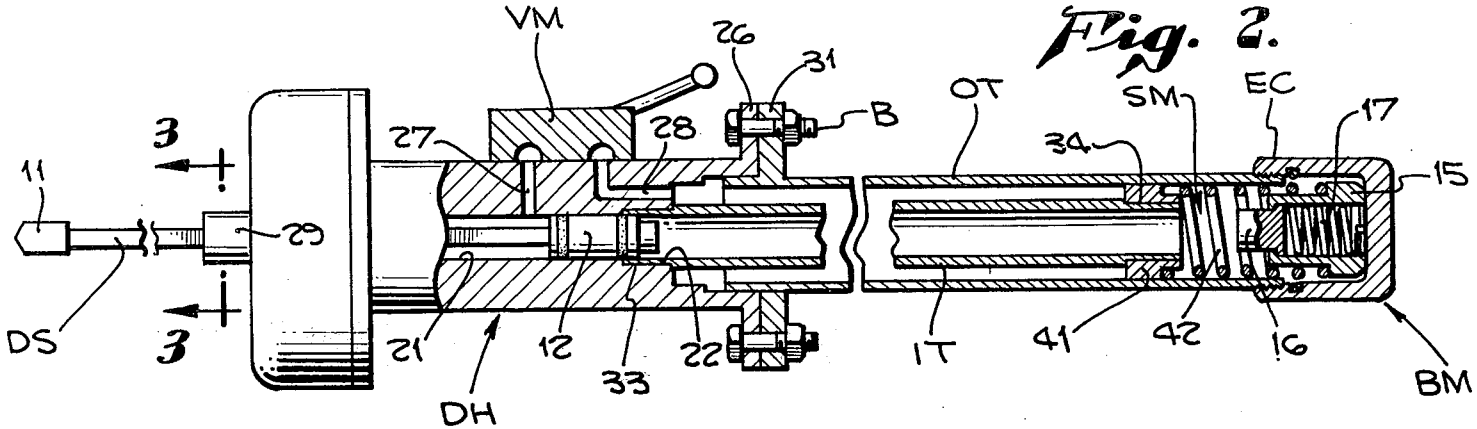
FIG. 2 is a longitudinal cross-sectional view of the machine of FIG. 1.

An inner tube or barrel IT is concentrically mounted within the outer tube OT, as shown in FIG. 2. Also shown in FIG. 2 is the cutterhead 11 at the forward end of drive shaft DS and drive piston 12 at its rearward end. Drive piston 12 reciprocates longitudinally within a drive cylinder which, for the most part, is provided by the inner tube IT.

Within the rear end cap EC there is provided a brake means BM, whose function it is to cushion the movement of the rearward end of the drive shaft as it comes to a halt at the end of the rearward stroke and as it is changing its direction to move forward. Brake means BM includes a plunger base 15, a plunger 16 reciprocable longitudinally within the base, and a bumper spring 17 which normally supports the plunger 16 in its forward position. When the rearward end of drive shaft DS strikes the plunger 16 it causes the plunger to compress the spring 17 towards the rearward end wall of cap EC, thereby absorbing substantial longitudinal impact from the drive shaft.

The tubes IT and OT, in cooperation with the central power unit, provide a hydraulic drive circuit which operates in the same general fashion as disclosed in my referenced U.S. Pat. No. 4,015,304. Before describing this hydraulic circuit, however, the specific method of attaching the tubes to the central power unit DH will be described.

The drive head or central power unit DH has a cylindrical longitudinal passageway 21 therein, which receives the drive piston 12 when the shaft is in its forward position as shown in FIG. 2. At the rearward end of the drive head there are three concentric cylindrical recesses which are concentric with each other and also with the cylindrical passageway 21. These include an inner recess 22, an intermediate recess 23, and an outer recess 24. At the rearward extremity of the drive head there is an external flange 26 which extends about its periphery.

The forward end of outer tube OT is received within the outer cylindrical recess 24 of the drive head. A short distance rearwardly of the forward end of outer tube OT a flange 31 is formed thereon which extends outwardly and around the entire periphery of the tube. As shown in FIG. 2 the flanges 31 and 26 are placed in mating engagement, and are fastened by a plurality of bolts B.

The inner barrel or tube IT has an external notch 33 at its forward end and an external notch 34 at its rearward end. The forward end of IT is received within the inner cylindrical recess 22 of the drive head. The shoulder formed by notch 33 abuts against the shoulder that is formed between recesses 22 and 23 of the drive head. At its rearward end the inner tube IT carries a spring retainer member 41, that is received by the rear end notch 34. A spring 42 is contained within outer tube OT and has one of its ends bearing against the spring retainer 41 while its other end bears against the enlarged rearward end of the plunger base 15. Retainer 41 and spring 42 together comprise spring means SM which constantly urges the forward end of inner tube IT into snug engagement with the body of the drive head. This method of mounting has been found to be of significant importance because of thermal expansion or contraction that can occur within the composite structure of the barrels or tubes.

Figure 5:
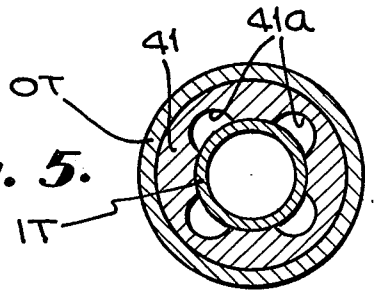
FIG. 5 is a cross-sectional view taken on line 5—5 of FIG. 4.

FIG. 5 shows the fluid passageways 41*a* that are formed in the inner periphery of the retainer 41. It is therefore seen that the annular space between the exterior of the inner tube IT and the interior wall of the outer tube OT provides a fluid passageway which, through the holes 41*a* of spring retainer 41 and the space inside the spring 42, communicates with the cylindrical passageway formed by the interior wall of inner tube IT. In this respect the arrangement of the hydraulic passageway is entirely similar to that shown in my above referenced earlier patent.

In the drive head or central power unit a lateral fluid passageway 27 communicates with the cylindrical passageway 21 at a location which, as shown in FIG. 2, is forward of the drive piston 12 even in the most forwardly advanced position of the drive shaft. Another fluid passageway 28 extends parallel to the cylindrical passageway 21 of the drive head and communicates with the annular space between the tubes IT and OT. A valve member VM on the drive head is manually actuated for the purpose of supplying hydraulic pressure to passageway 28 when the drive shaft is to be driven forward, or to the passageway 27 when the drive shaft is to be driven rearwardly. Here again the arrangement and operation of the hydraulic system is the same as shown in my previously referenced patent.

Figure 4:
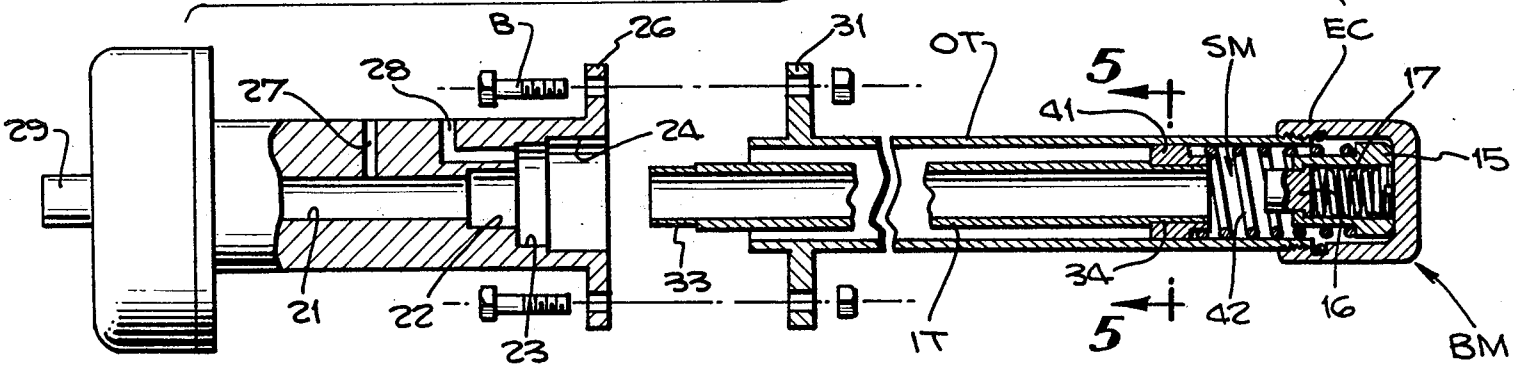
FIG. 4 is an exploded view, partially in cross-section, showing the barrels detached from the central power unit.

The previously described structure for attaching the tubes IT and OT to the central power unit make it possible to detach them very easily and quickly. The detached or exploded position of these parts is shown in FIG. 4.

CHANGING THE MACHINE LENGTH

Figure 3:
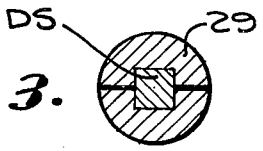
FIG. 3 is a cross-sectional view of the kelly drive.

When changing from one set of removable parts to another it would be possible to disassemble the component parts of the drive shaft, either by removing the cutterhead 11 from the forward end or the drive piston 12 from the rearward end. In practice, however, it is preferred not to do this, but to leave the drive shaft assembly intact. Rotational drive for the drive shaft is provided through a kelly drive as well known in the prior art and as shown and described in my previously referenced patent. As shown in FIG. 3 of the present drawings, a packing gland 29 encloses the square structure of the drive shaft for imparting the rotating drive to it. The packing gland 29 is so constructed that it can be easily withdrawn, by means well known in the art but not specifically shown in the drawings.

Therefore, when changing from one set of removable parts to another the procedure is as follows. Bolts B are released for detaching the rearwardly extending tubes IT and OT together with their end cap EC, brake means BM, and spring means SM. Packing gland 29 is then withdrawn so that the drive shaft assembly may be withdrawn rearwardly from the machine at the same time that the tubes IT and OT are taken off. Then a new assembly consisting of drive shaft assembly and tubes IT and OT and their related parts is placed within the machine. After the drive shaft is moved forwardly through the drive head the packing gland 29 is then returned to its operative position. Then the tubes IT and OT are placed in position and bolts B are again used to fasten the flanges 26 and 31 together. The machine is then ready to operate, but of course with a different operating length than it previously had.

Figure 6:
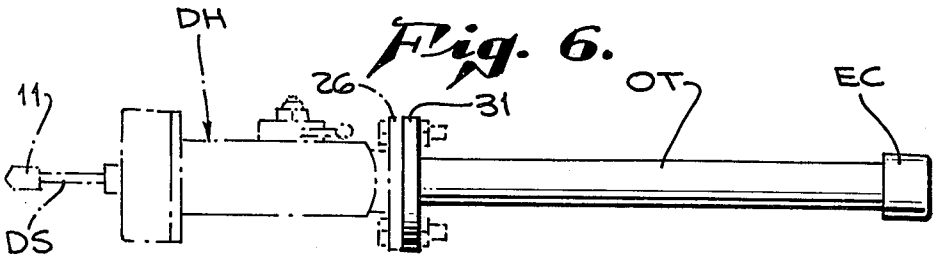
FIG. 6 is a side elevation view of the machine when modified for a shorter cutting length.
Figure 7:
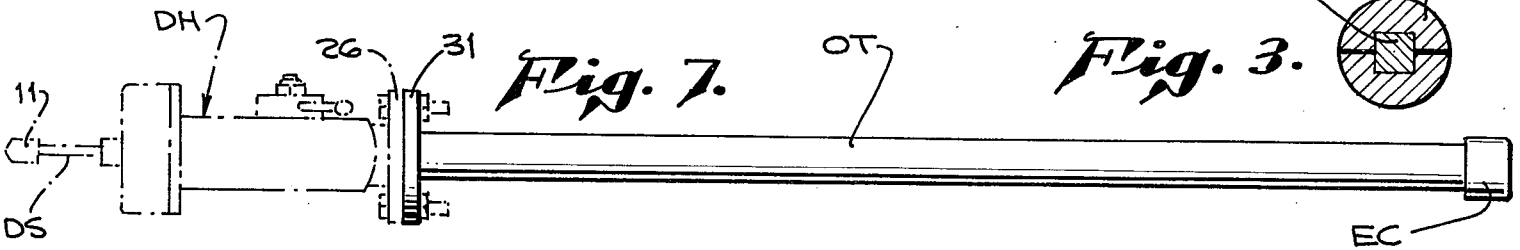
FIG. 7 is a side elevation view of the machine when modified for a longer cutting length.

FIG. 6 shows the machine when modified for a shorter cutting or reaming depth. FIG. 7 shows the machine when modified for a greater operating length.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. In a machine for reaming heat exchanger tubes, of the type including a drive shaft having a cutterhead on its forward end and a drive piston on its rearward end, means providing a cylindrical passageway for housing the drive piston and the rearward part of the shaft, and fluid drive means for applying fluid pressure alternately to the forward and rearward ends of the piston so as to drive the shaft in a longitudinal reciprocating movement, an improved construction for adapting the machine to heat exchangers of different lengths, comprising:

a drive head which incorporates the forward end of said passageway;

a pair of elongated concentric tubes;

means removably securing the forward ends of said tubes to the rearward end of said drive head so that the inner one of said tubes then provides the remainder of the cylindrical passageway;

means enclosing the rearward ends of said tubes but providing a fluid passageway therebetween; and the drive shaft and said tubes being removable from said drive head for purpose of replacing them with like members having a length corresponding to the length of a particular heat exchanger whose tubes are to be reamed.

2. A tube reaming machine comprising:

a drive shaft having a cutterhead on its forward end and a drive piston on its rearward end;

a drive head having a cylindrical passageway for receiving said drive piston, having one fluid passageway extending laterally into said cylindrical passageway and having another fluid passageway which extends parallel to the rearward end of said cylindrical passageway;

inner and outer concentrically arranged tubes;

means movably securing the forward ends of said tubes to the rearward end of said drive head so that said inner tube provides an extension of said cylindrical passageway while said other fluid passageway communicates with the annular space between said tubes; and means enclosing the rearward ends of said tubes but providing a fluid passageway between the interior and exterior sides of said inner tube.

3. The machine of claim 2 wherein the rearward end of said drive head has concentric cylindrical recesses therein for receiving the forward ends of said inner and outer tubes, respectively; said outer tube has an exterior flange formed thereon near its forward end; said drive head has a mating flange formed thereon; and which further includes means removably securing said two flanges together.

4. The machine of claim 3 which further includes spring means carried within the rearward end of said outer tube and engaging the rearward end of said inner tube for urging the forward end thereof into mating engagement with said drive head.

5. The machine of claim 2 which also includes brake means in the rearward end of said outer tube for absorbing the impact of said drive shaft when said shaft nears the end of its rearward stroke.

6. In a tube reaming machine, the combination comprising:

a drive head having forward and rearward ends and a cylindrical passageway extending therebetween, inner and outer cylindrical recesses in its rearward end which are concentric to each other and to said cylindrical passageway, and an exterior flange at its rearward end about said outer recess;

inner and outer tubes whose forward ends are adapted to fit within corresponding ones of said recesses, said outer tube having an external flange near its forward end;

means removably securing said flanges together;

means enclosing the rearward ends of said tubes and supporting said tubes in concentric relationship but providing a fluid passageway between the interior and exterior of said inner tube;

said drive head having one fluid passageway which communicates with said cylindrical passageway and another fluid passageway which communicates with the annular space between said tubes; and spring means carried within the rearward end of said outer tube and urging said inner tube against said drive head.

* * * * *